US006224645B1

(12) United States Patent
Rydin et al.

(10) Patent No.: US 6,224,645 B1
(45) Date of Patent: May 1, 2001

(54) DUST SEPARATOR

(76) Inventors: Anders Rydin, Grönviksvägen 163, Bromma (SE), 167 76; Reidar Liland, Elias Lönnrots väg 27, Bromma (SE), 161 59

( * ) Notice: Subject to any disclaimer, the term of this patent is extended or adjusted under 35 U.S.C. 154(b) by 0 days.

(21) Appl. No.: 09/308,236

(22) PCT Filed: Nov. 20, 1997

(86) PCT No.: PCT/SE97/01946

§ 371 Date: May 21, 1999

§ 102(e) Date: May 21, 1999

(87) PCT Pub. No.: WO98/22014

PCT Pub. Date: May 28, 1998

(30) Foreign Application Priority Data

Nov. 21, 1996 (SE) ..... 9604267

(51) Int. Cl.[7] ..... B01D 46/00

(52) U.S. Cl. ..... 55/367; 55/361; 55/369; 55/377; 55/DIG. 2

(58) Field of Search ..... 55/361, 367, 369, 55/377, 380, 381, DIG. 2, DIG. 3

(56) References Cited

U.S. PATENT DOCUMENTS 2,237,499 4/1941 Osterdahl .
4,539,027 9/1985 Fornas et al. .
5,507,859 * 4/1996 Kaiser ..... 55/DIG. 3

FOREIGN PATENT DOCUMENTS

964411 * 3/1975 (CA) ..... 55/DIG. 2
2130222 * 12/1971 (DE) ..... 55/DIG. 2
2352602 * 4/1975 (DE) ..... 55/DIG. 2
384 627 5/1976 (SE) .
501 135 11/1994 (SE) .

* cited by examiner

*Primary Examiner*—David A. Simmons
*Assistant Examiner*—Minh-Chau T. Pham
(74) *Attorney, Agent, or Firm*—Jacobson, Price, Holman & Stern, PLLC

(57) ABSTRACT

A dust separator for a vacuum cleaner, in which the bag is sealingly connected to a rigid member that screens-off an air-flow passageway through the vacuum cleaner and has an opening with which the bag connects. The screening member is separate from the bag. Mounted at the orifice of the bag is a flange which functions to prevent the bag from being drawn through the opening in the screening member in the direction of air flow through the vacuum cleaner. The flange can be collapsed to enable it to be passed through the opening in the screening member when the bag is full.

20 Claims, 1 Drawing Sheet

DUST SEPARATOR

BACKGROUND OF THE INVENTION

1. Field of the Invention

The present invention relates to a dust separator for a vacuum cleaner in which the bag is sealingly connected to a rigid screening plate around an opening through the plate, wherein the plate screens-off an air-flow passage through the vacuum cleaner.

2. Description of the Related Art

In conventional vacuum cleaners of the kind to which the invention refers, the air-permeable and dust-separating bag is connected permanently to the screening plate, wherewith the plate and the actual bag are both replaced at the same time when the bag is full and needs replacing.

Dust separator units that include a bag which is permanently connected to a rigid screening plate must be stocked in many different models and makes, since the air-flow passageways of different makes and models of vacuum cleaners have different designs and dimensions, therewith requiring a screening plate of corresponding design and dimensions in order for the plate to screen-off the passageway.

It is therefore obvious that such dust separator units will demand a relatively high price, owing to the fact that they must be produced in relatively small numbers. Furthermore, consumer stations are obliged to provide dust separator units of many different designs, in order to meet different consumer requirements.

This results in high manufacturing and retail costs, which means a relatively high price for individual dust separators in respect of the customer at the "end of the line".

It is also necessary for the customer to be aware of the make, year model, etc., of his or her vacuum cleaner, if she/he is to choose the correct "dust separator bag" in the store or shop.

It is also a common occurrence that the range of dust separators kept in stock will not include one or more of the actual type of separator required by the customer.

SUMMARY OF THE INVETNTION

An object of the present invention is to reduce these drawbacks.

The inventive dust separator differs from a conventional, known dust separator in that the actual bag is in itself a unit that is separate from the aforementioned screening-off plate, in that the bag has a flange which functions to prevent the bag from being drawn through the opening in the plate in the direction of air flow, and in that the flange is collapsible, preferably manually collapsible, so as to enable the flange to be passed through the plate opening when needing to change a full bag. The main part of the bag can be threaded bottom-first through the plate opening in the direction of air flow until the flange rests against the upstream surface of the plate. The flange may have a generally annular configuration, so that its solid-ring surface will abut the plate around the plate opening and therewith establish an effective seal. If desired, a sealing agent, e.g. a plastic foam annulus or the like, may be mounted on the surface of the flange that faces towards the plate. Plate openings are, in the main, similar in different plates for different vacuum cleaner models and makes. Thus, the different plates normally have a circular opening of specific diameter.

The flange may be made collapsible, by providing the flange with a generally radial weakening or fold indication for instance, which enables the flange to be folded or bent around a line that generally or approximately constitutes a flange diameter. That side of the flange which lies distal from the plate may be provided with an adhesive and the adhesive covered with a peelable release strip. The adhesive may be disposed so as to seal the bag when the flange is collapsed around said weakening or fold indication. Naturally, the flange may include several weakenings which enable the flange to be folded, bent or wrinkled around several axes.

The flange weakenings are thus intended to enable the flange to be collapsed to a size that will enable the flange to be threaded through the plate opening, especially when the bag shall be removed from the plate when the bag is full. It will be understood, however, that the bag can also be fitted to the plate by first collapsing the flange around a fold weakening and then threading the flange through the plate opening in a direction opposite to the direction of air flow, and thereafter opening out the flange to a plane that lies parallel with and adjacent to the plane of the plate.

As before mentioned, the flange may conveniently be designed to be collapsed manually.

BRIEF DESCRIPTION OF THE DRAWINGS

The invention will now be described in more detail with reference to an exemplifying embodiment thereof and also with reference to the accompanying drawing.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
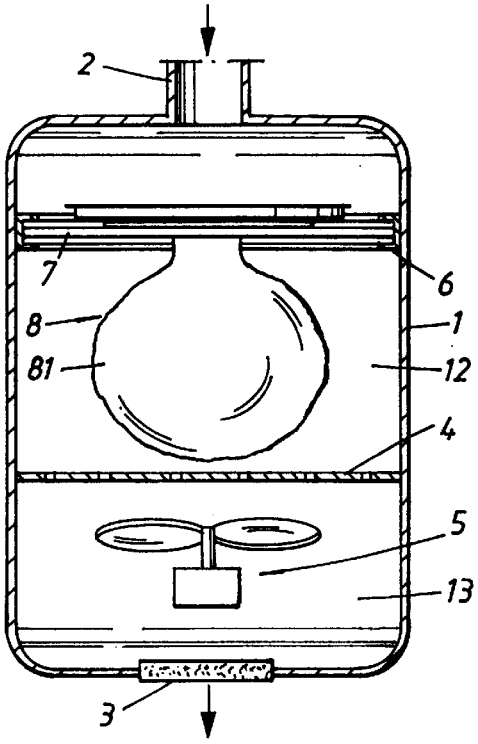
FIG. 1 is a schematic sectional view of a vacuum cleaner that includes a dust separator.

FIG. 1 illustrates schematically a vacuum cleaner that comprises a housing 1 which includes a connection inlet 2 to which a vacuum cleaner hose can be connected, and an outlet aperture 3. The housing 1 forms an air-flow passageway between the hose-connector 2 and the outflow aperture 3. Mounted on the inner surface of the housing 1 is a fitting 6 which receives the edge of a screening-off plate 7 that screens-off the cross-section of the housing 1. The neck of a dust-separating, air-permeable bag 8 is sealingly connected to the screening-off plate 7 around a plate aperture 71.

Also mounted in the housing 1 is an air-permeable, e.g. perforated, plate 4 which together with the fitting 6 and the screening-off plate 7 defines a bag-accommodating space 12. The dust-freed air passes through the air-permeable plate 4 and into a fan chamber 13 in which there is mounted a fan unit 5 which drives the air through the vacuum cleaner.

In the case of conventional technology, it is necessary to supply or have in stock a plurality of dust separator units 7, 8 that comprise a bag 8 and a screening-off plate 7 connected thereto. The difference between the various types of bags resides mainly in the outer shape of the screening-off plate 7, which must be adapted to the fitting 6 of the model or make of vacuum cleaner concerned, so that the screening-off plate 7 will effectively screen-off the airflow passageway in the vacuum cleaner.

Figure 2:
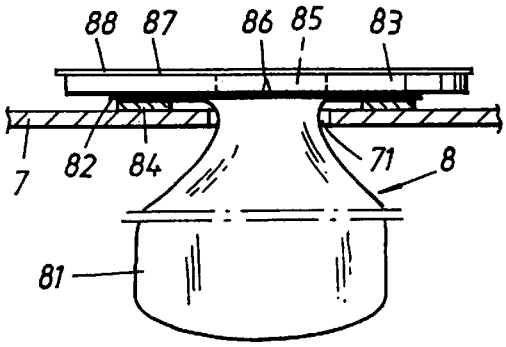
FIG. 2 is a schematic sectional view of a dust separator that includes an inventive vacuum cleaner bag.

In the case of the inventive dust separator, the bag 8 and the screening-off plate 7 are separate components, as evident from FIG. 2. In the simplest case, the screening-off plate 7 may be a plate that has been removed from a known dust separator unit 7, 8 from which the bag 8 has been removed. The inventive bag 8 includes a true dust separator bag 81 made of a flexible, air-permeable material. The orifice 82 of the bag 81 is fixedly joined to a generally annular plate or flange 83 that includes an opening or aperture 85 which corresponds generally to the aperture or opening 71 in the screening-off plate 7. The annular plate 83 is joined stably to the neck-part 82 of the bag 81, wherewith said neck-part 82 may be glued to or moulded in the plate 83. A sealing ring 84 may be mounted on the side of the plate 83 that lies proximal to the screening-off plate 7, so as to prevent air from leaking between the neck of the bag 81 and the edge of the plate opening 71.

Because the actual bag 81 is thin and flexible, it can be compressed and threaded bottom-first through the plate opening 71, until the annular plate or flange 83 rests on the upper side of the screening-off plate 7 in the inlet chamber between the fitting 6 and the hose-connector 2.

As will be seen from FIG. 2, a diametrically extending weakening 86 is provided on the underside of the annular plate 83. It will also be seen that there is provided on the upper side of the annular plate 83 an adhesive coating 87 that extends at least around half of the circumference of said plate from the weakening 86. This adhesive coating is covered by a peelable release strip 88.

Figure 3:
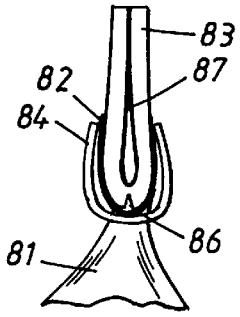
FIG. 3 is a schematic illustration of the support flange of the vacuum cleaner bag in a collapsed, sealed state.

When the bag 81 is full, the person using the vacuum cleaner can remove the release strip 88 and fold the annular plate 83 together around the defined, generally diametrical weakening or fold indication 86, so that the adhesive coating 87 will adhere to itself and/or to the upper side of the annular plate 83, such as to effectively seal the bag 81, as shown in FIG. 3.

Figure 4:
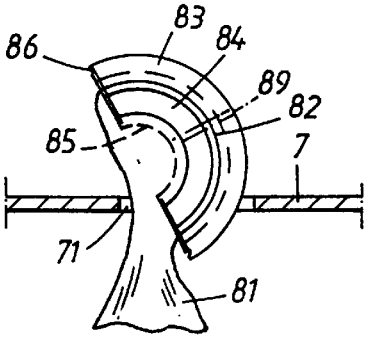
FIG. 4 is a schematic illustration showing how the collapsed bag-flange is passed out through an aperture in the bag carrier plate.

As shown in FIG. 4, the annular plate 83 is brought generally to a half-moon shape which enables the plate to be inserted down through the opening 71 and therewith enable the bag 8 to be completely removed from the screening-off plate 7.

It will also be seen from FIG. 4 that the annular plate 83 may be provided with further weakenings or fold indications 89 that also extend conveniently diametrically across the planar surface of the plate, so as to enable the annular plate 83 to be folded one more time to a size that corresponds to half the configuration of the annular plate shown in FIG. 4.

It will be understood that the illustrated embodiment can be varied and modified in different ways. For instance, the sealing element 84 can be replaced with or consist of a weakly adhesive, two-sided adhesive annulus on the underside of the annular plate 83 around the opening 85, so as to provide an adhesive connection between the adhesive plate 83 and the screening-off plate 7.

It will also be evident that the annular plate 83 need not necessarily have actual weakenings or fold indications 86, 89 that extend diametrically. Instead, the breaking strength or flexural strength of the annular plate 83 may be such as to enable the person removing the bag to manually deform the plate 83 to an extent that will enable the deformed or collapsed plate to be threaded through the opening 71 in the screening-off plate 7. One important advantage afforded by the inventive bag is that one single bag design (or possibly a few bag designs) can be used in many different vacuum cleaner models that all originally required the dust separator unit 7, 8 to have a screening-off plate 7 that was designed particularly for the vacuum cleaner concerned. The inventive bag 8 can be used together with a screening-off plate 7 torn from a dust separator unit 7, 8 of a design originally intended for the vacuum cleaner/vacuum cleaner model in question.

Although it has been said in the aforegoing that the bag 8 is fitted to the screening-off plate 7 by threading the bottom part of the actual bag 81 through the opening 71 in the screening-off plate 7, it will be obvious that the annular plate 83 may, instead, be collapsed or folded around a diameter for instance, and then threaded up through the opening 71 in the screening-off plate 7 and then flattened out so as to bring the annular plate 83 to the position shown in FIG. 2.

Because the diameter of the opening 71 in the screening-off plate 7 is roughly the same size as the diameter of the hose connector 2 and the vacuum cleaner hose, the inner diameter of the flange can correspond to the diameter of the opening 71, therewith enabling the flange to be given the requisite stiffness and also simplifying the collapsibility of the flange.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

What is claimed is:

1. A dust separator for a vacuum cleaner comprising a bag which is sealingly connected to a rigid screening-off plate positioned in an air-flow passageway through the vacuum cleaner and having an opening with which the bag connects, wherein the screening plate is separate from the bag, and wherein an orifice of the bag extends through the opening in the screening plate, said bag including at said orifice a rigid flange that functions to prevent the bag from being drawn through the opening in the screening plate in the direction of air flow through the vacuum cleaner, and said flange being foldable so as to enable said flange, when folded, to close said orifice and be passed through the opening of the screening plate in the direction of air flow through the vacuum cleaner when the bag is full.

2. The dust separator according to claim 1, wherein said flange is constructed to be in sealing contact with the screening plate around a circumference of the opening in said screening plate.

3. The dust separator according to claim 1, wherein a surface of the flange proximal to the screening plate includes sealing means.

4. The dust separator according to claim 1, wherein said flange has at least one generally radial fold indication which enables the flange to be folded essentially about a flange diameter.

5. The dust separator according to claim 1, wherein a side of the flange distal from the screening plate is provided with an adhesive means to enable the bag to be sealed when the flange is folded.

6. The dust separator according to claim 1, wherein said flange includes several fold indications which enable the flange to be folded about several axes defined by said fold indications.

7. The dust separator according to claim 4, wherein said fold indications enable the flange to be folded to a size that will enable a user to thread the folded flange through the opening in the screening plate.

8. The dust separator according to claim 1, wherein said flange can be folded manually.

9. The dust separator according to claim 1, wherein a body of the bag, when the bag is essentially empty, can be threaded through the opening in the screening plate in the direction of air flow in the vacuum cleaner until said flange abuts said screening plate.

10. The dust separator according to claim 1, wherein said flange is annular.

11. A dust separator for a vacuum cleaner having an air flow passageway with a rigid screening-off plate positioned therein, said plate having an opening to permit air flow therethrough, said separator comprising a bag having a bottom, an orifice distal to said bottom, and a flange at said orifice, said orifice extending through said opening in said plate to receive incoming air flow and said flange functioning to prevent the orifice of the bag from being pushed through the opening by the air flow toward the bottom of the bag, said flange being foldable by a user so that, when the bag is full, said flange may be folded, thereby closing said orifice, and passed through the opening of the screening plate in the direction of air flow through the vacuum cleaner.

12. The dust separator according to claim 11, wherein said flange is annular and in sealing contact with the screening plate around a circumference of said opening.

13. The dust separator according to claim 11, wherein a surface of the flange proximal to the screening plate includes sealing means.

14. The dust separator according to claim 11, wherein said flange has at least one fold indication.

15. The dust separator according to claim 11, wherein a side of the flange distal from the screening plate is provided with an adhesive means to enable the bag to be sealed when the flange is folded.

16. The dust separator according to claim 15, wherein said adhesive means includes an adhesive coating covered by a peelable release strip.

17. The dust separator according to claim 11, wherein said flange includes several fold indications.

18. The dust separator according to claim 11, wherein said flange can be folded manually.

19. The dust separator according to claim 11, wherein the bag, when the bag is essentially empty, can be threaded bottom-first through the opening in the screening plate in the direction of air flow through the vacuum cleaner.

20. The dust separator according to claim 11, wherein said flange is annular and includes at least one generally radial fold indication which enables the flange to be folded essentially about a flange diameter.

* * * * *